US008251649B2

(12) United States Patent
Goto et al.

(10) Patent No.: US 8,251,649 B2
(45) Date of Patent: Aug. 28, 2012

(54) BLADE ROW OF AXIAL FLOW TYPE COMPRESSOR

(75) Inventors: Shinya Goto, Tokyo (JP); Takeshi Murooka, Tokyo (JP)

(73) Assignee: IHI Corporation, Tokyo (JP)

( * ) Notice: Subject to any disclaimer, the term of this patent is extended or adjusted under 35 U.S.C. 154(b) by 491 days.

(21) Appl. No.: 12/513,623

(22) PCT Filed: Mar. 27, 2007

(86) PCT No.: PCT/JP2007/056371

§ 371 (c)(1),
(2), (4) Date: May 2, 2010

(87) PCT Pub. No.: WO2008/075467

PCT Pub. Date: Jun. 26, 2008

(65) Prior Publication Data

US 2010/0135781 A1 Jun. 3, 2010

(30) Foreign Application Priority Data

Dec. 18, 2006 (JP) ..... 2006/339433

(51) Int. Cl.
*F04D 29/54* (2006.01)
*F04D 29/38* (2006.01)
*F04D 29/66* (2006.01)

(52) U.S. Cl. ..... 415/191; 415/194; 415/208.1; 415/208.2

(58) Field of Classification Search ..... 415/191, 415/194, 208.1, 208.2
See application file for complete search history.

(56) References Cited

U.S. PATENT DOCUMENTS

| | | | | |
|---|---|---|---|---|
| 5,002,461 | A | 3/1991 | Young et al. | |
| 5,639,217 | A | 6/1997 | Ohtsuki et al. | |
| 5,730,582 | A * | 3/1998 | Heitmann | 416/188 |
| 6,508,626 | B1 * | 1/2003 | Sakurai et al. | 416/180 |

FOREIGN PATENT DOCUMENTS

| | | |
|---|---|---|
| JP | 06-257597 | 9/1994 |
| JP | 07-224794 | 8/1995 |
| WO | 98/53211 | 11/1998 |
| WO | 2006/080386 A1 | 8/2006 |

OTHER PUBLICATIONS

International Search Report, issued in corresponding application PCT/JP2007/056371, completed Apr. 27, 2007, mailed May 15, 2007.

* cited by examiner

*Primary Examiner* — Igor Kershteyn
(74) *Attorney, Agent, or Firm* — Griffin & Szipl, P.C.

(57) ABSTRACT

In a blade row of an axial flow type compressor in which a rotor blade row and a stator blade row are alternately arranged in an axial direction, the stator blade row 10 is formed by plural main stator blades 12 and plural sub-stator blades 14. Each main stator blade 12 is formed by a basic blade portion 12*a* which has the same shape as that of each sub-stator blade and a forward blade portion 12*b* which extends to the upstream side of the basic blade portion. The basic blade portion 12*a* are located at the same position in an axial direction. The forward blade portion 12*b* forms a forward stator blade row which has a circumferential interval larger than that of the basic stator blade row in the vicinity of at least a radial inner end.

3 Claims, 7 Drawing Sheets streamlines of brade surfaces

Base Type

Invented Type

BLADE ROW OF AXIAL FLOW TYPE COMPRESSOR

This is a National Phase Application in the United States of International Patent Application No. PCT/JP2007/056371 filed Mar. 27, 2007, which claims priority on Japanese Patent Application No. 2006/339433, filed Dec. 18, 2006. The entire disclosures of the above patent applications are hereby incorporated by reference.

BACKGROUND OF THE INVENTION

1. Technical Field of the Invention

The present invention relates to a blade row of an axial flow type compressor in which a rotor blade row and a stator blade row are alternately arranged in an axial direction.

2. Description of the Related Art

In a gas turbine or a jet engine, a compressor for compressing an air introduced from the outside is configured as an axial flow type compressor in which a rotor blade row and a stator blade row are arranged in an axial direction.

In the axial flow type compressor, since an inflow mach number becomes high at a position on the side of a radial inner diameter (on the hub side) of a stator blade forming the stator blade row under the condition of a high flow rate and a high pressure, choking easily occurs in a minimum valid passageway sectional portion (throat area), thereby increasing pressure loss. Additionally, the flow rate cannot increase any more when the choking occurs.

In the axial flow type compressor, a chord length may be increased in order to realize a high pressure at a position on the side of the radial inner diameter (on the hub side) of a rotor blade forming the rotor blade row. However, since friction loss also increases, the advantage of the increased chord length becomes small. Since a relative inflow mach number is large at a position on the side of a radial outer diameter (on the tip side), pressure loss increases due to an acceleration before a throat area. Additionally, since the choking easily occurs, the flow rate cannot increase.

Therefore, Patent Document 1 has already disclosed a technique for solving the above-described problems.

A blade row structure of an axial flow type compressor disclosed in Patent Document 1 aims to realize high flow rate and high efficiency of the compressor. As shown in FIG. 1, in a blade row structure of an axial flow type compressor 65 in which plural blades 63 are arranged between an outer passageway wall 61 and an inner passageway wall 62 arranged in an annular shape so as to have an interval therebetween in a circumferential direction, the inner passageway wall 62 is provided with a concave portion 65 which is located at a throat portion 64, in which a passageway sectional area in the row of the blades 63 becomes minimum, so as to expand a passageway sectional area, and is provided with a smooth convex portion 68 which is located on the downstream side of the concave portion 65 so as to suppress a deceleration of a fluid flowing through a base portion 67 on the rear side of the blade.

Additionally, Patent Documents 2 and 3 have disclosed a centrifugal compressor different from the axial flow type compressor.

In Patent Document 2, as shown in FIG. 2, there is disclosed an impeller including a hub 71, plural main blades 72 which are formed in the hub, and plural splitter blades 73 which are formed in the hub. In this impeller, each splitter blade 73 is formed between the adjacent main blades 72.

In Patent Document 3, as shown in FIG. 3, there is disclosed an impeller including a rotary disc 82 which has a hub 81 suitable for a rotary shaft, plural full blades 83 which are formed on a surface of the rotary disc, and plural splitter blades 84 which are formed on the surface of the rotary disc. In this impeller, the full blades 83 and the splitter blades 84 are alternately arranged in a rotary direction of the rotary disc.

[Patent Document 1]

Japanese Patent Application Laid-Open No. H06-257597 "BLADE ROW STRUCTURE OF AXIAL FLOW TYPE COMPRESSOR"

[Patent Document 2]

U.S. Pat. No. 5,002,461

[Patent Document 3]

U.S. Pat. No. 5,639,217

As described above, in the axial flow type compressor, a problem arises in that pressure loss of the rotor blade row and the stator blade row increases in the case of a high inflow mach number, and a problem arises in that a choking occurs in the throat portion in the blade row and an inflow air flow rate is limited. In Patent Document 1 described above, it is expected that a local advantage is exhibited, but a three-dimensional advantage is small.

Additionally, especially in the case of a fan, it is configured such that the number of the stator blades is larger than that of the rotor blades and a cutoff condition advantageous in noise is established. However, as described above, in order to handle the high-mach-number fluid, it is necessary to expand an area between blades. As expanding means, means for decreasing the number of stator blades may be supposed. However, since the number of rotor blades is approximately equal to that of the stator blades, a problem arises in that noise increases.

SUMMARY OF THE INVENTION

The present invention is contrived to solve the above-described problems. That is, an object of the invention is to provide a blade row of an axial flow type compressor capable of more reducing pressure loss and of more improving an air flow rate than those of the conventional art in the case of a high inflow mach number by three-dimensionally and actively adjusting a blade shape.

According to the invention, there is provided a blade row of an axial flow type compressor in which a rotor blade row and a stator blade row are alternately arranged in an axial direction, wherein the stator blade row is formed by plural main stator blades which are located in a circumferential direction of a rotary axis of the rotor blade row so as to have an interval therebetween and plural sub-stator blades which are located between the main stator blades in a circumferential direction so as to have an interval therebetween, wherein each main stator blade is formed by a basic blade portion which has the same shape as that of each sub-stator blade and a forward blade portion which extends to the upstream side of the basic blade portion, wherein the basic blade portion of the main stator blade and the sub-stator blade are located at the same position in an axial direction so as to form a basic stator blade row therebetween, and wherein the forward blade portion of the main stator blade forms a forward stator blade row which has a circumferential interval larger than that of the basic stator blade row in the vicinity of at least a radial inner end.

According to the invention, there is provided a blade row of an axial flow type compressor in which a rotor blade row and a stator blade row are alternately arranged in an axial direction, wherein the rotor blade row is formed by plural main rotor blades which are located in a circumferential direction of a rotary axis thereof so as to have an interval therebetween and plural sub-rotor blades which are located between the main rotor blades in a circumferential direction so as to have an interval therebetween, wherein each main rotor blade is formed by a basic blade portion which has the same shape as that of each sub-rotor blade and a forward blade portion which extends to the upstream side of the basic blade portion, wherein the basic blade portion of the main rotor blade and the sub-rotor blade are located at the same position in an axial direction so as to form a basic rotor blade row therebetween, and wherein the forward blade portion of the main rotor blade forms a forward rotor blade row which has a circumferential interval larger than that of the basic rotor blade row in the vicinity of at least a radial inner end.

According to the preferred embodiment of the invention, a front edge of the main rotor blade is located on the downstream side of a front edge of the sub-rotor blade from a radial middle portion to an outer end.

According to the configuration of the invention, the stator blade row is formed by the basic stator blade row which is formed by the basic blade portion of the main stator blade and the sub-stator blade and the forward stator blade row which is formed by only the forward blade portion of the main stator blade. The circumferential interval of the forward stator blade row is larger than that of the basic stator blade row (by approximately two times) in the vicinity of at least the radial inner end. Accordingly, even in the case where a high-mach-number fluid flows into the stator blade row on the hub side, it is possible to expect a wide dynamic range, high efficiency, and an expansion of a throat area on the hub side determined by the interval of the forward blade row.

Since the basic blade portion of the main stator blade has the same shape as that of the sub-stator blade from the vicinity of a mid-span except for the vicinity of the radial inner end to the tip side, the basic stator blade row formed by the basic blade portion of the main stator blade and the sub-stator blade has the same configuration as that of the conventional stator blade row, and the number of rotor blades and stator blades is the same as that of the conventional art, thereby maintaining a cutoff condition which is advantageous in noise caused by the interference between the rotor blade and the stator blade.

In addition, it is possible to realize a decrease in weight as a whole as much as the short sub-stator blade on the hub side.

According to the above-described configuration of the invention, the rotor blade row is formed by the basic rotor blade row which is formed by the basic blade portion of the main rotor blade and the sub-rotor blade and the forward rotor blade row which is formed by only the forward blade portion of the main rotor blade. The number of blades of the forward rotor blade row is smaller than that of (is a half of) the basic rotor blade row. Accordingly, it is possible to reduce the fluid friction loss of the blade portion and to efficiently increase the pressure.

Since the circumferential interval of the forward rotor blade row in the vicinity of the radial inner end is larger than that of the basic rotor blade row (by approximately two times), it is possible to expect a wide dynamic range, high efficiency, and an expansion of a throat area on the hub side determined by the interval of the forward blade row.

With the configuration in which the front edge of the main rotor blade is located on the downstream side of the front edge of the sub-rotor blade from the radial middle portion to the outer end, the circumferential interval of the front edge of the sub-rotor blade on the tip side is large (by approximately two times). Accordingly, it is possible to expand the throat area at the tip side and to expect the pressure loss reduction at a high-ratio flow rate.

In addition, it is possible to realize a decrease in weight as a whole as much as the short sub-rotor blade on the hub side.

Accordingly, in any case of the stator blade row and the rotor blade row, it is possible to reduce pressure loss of the compressor, and to more increase an air flow rate while maintaining a compression characteristic than that of the conventional art.

Further, the above-described advantage according to the invention is verified by means of the CFD (computer fluid dynamics) analysis.

DESCRIPTION OF THE PREFERRED EMBODIMENT

Figure 1:
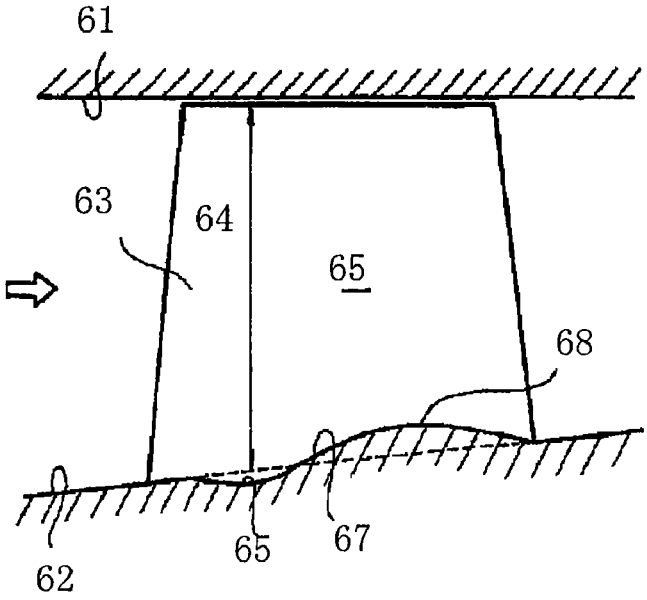
Fig. 1 Prior Art
FIG. 1 is a schematic view showing a blade row structure of an axial flow type compressor disclosed in Patent Document 1.
Figure 2:
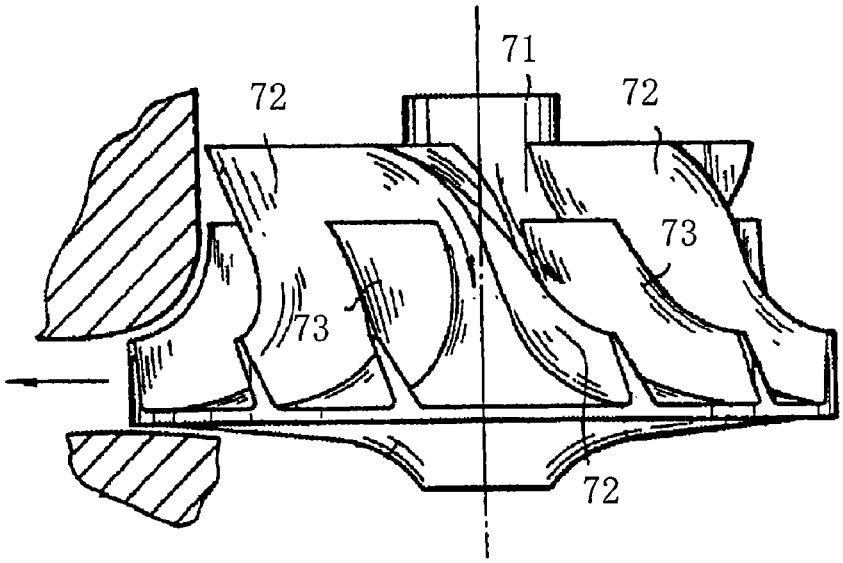
Fig. 2 Prior Art
FIG. 2 is a schematic view showing Patent Document 2.
Figure 3:
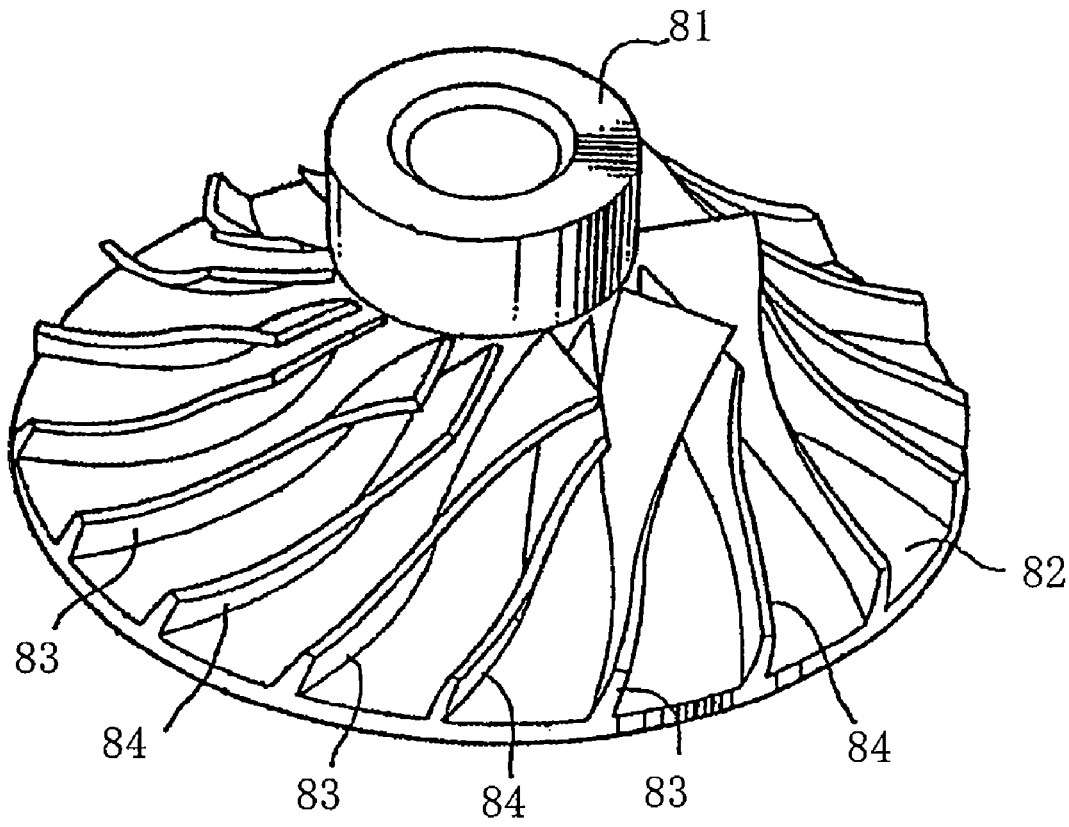
Fig. 3 Prior Art
FIG. 3 is a schematic view showing Patent Document 3.

Hereinafter, preferred embodiments of the invention will be described with reference to the accompanying drawings. Additionally, in the respective drawings, the same reference numerals are given to the same components, and the repetitive description thereof will be omitted.

Figure 4A:
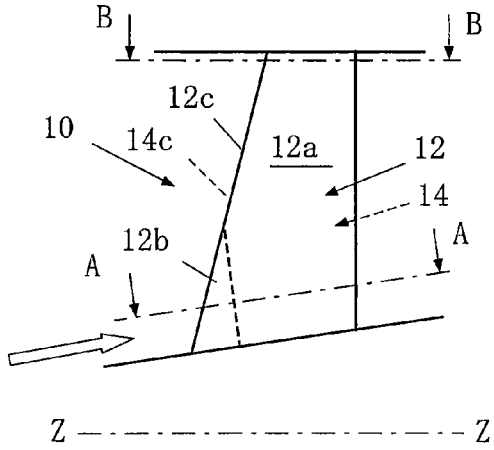
FIG. 4A is a view showing a blade row of an axial flow type compressor according to a first embodiment of the invention.
Figure 4B:
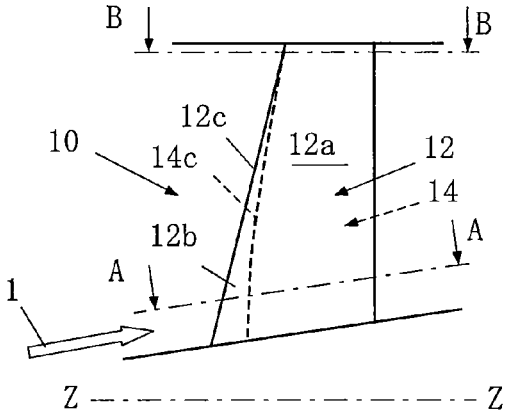
FIG. 4B is a view showing a blade row of an axial flow type compressor according to a second embodiment of the invention.
Figure 4C:
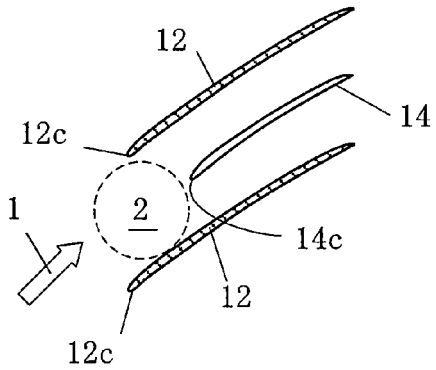
FIG. 4C is a sectional view taken along the line A-A of FIGS. 4A and 4B.
Figure 4D:
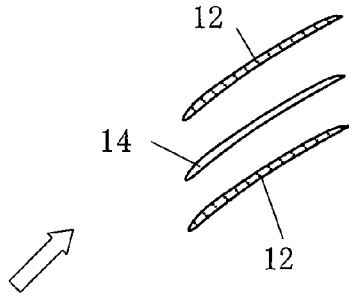
FIG. 4D is a sectional view taken along the line B-B of FIGS. 4A and 4B.

FIGS. 4A to 4C are examples in which the blade row according to the invention is applied to a stator blade row. In these drawings, FIG. 4A shows a first embodiment, FIG. 4B shows a second embodiment, FIG. 4C is a sectional view taken along the line A-A, and FIG. 4D is a sectional view taken along the line B-B.

FIG. 4A is a schematic side view showing a stator blade row 10 according to the first embodiment of the invention. In this drawing, the stator blade row 10 according to the invention is formed by plural main stator blades 12 and plural sub-stator blades 14. In this drawing, each sub-stator blade 14 is located on the rear side of each main stator blade 12.

The plural main stator blades 12 are located in a circumferential direction of a rotary axis Z-Z of a rotor blade row (not shown) so as to have an interval therebetween. Additionally, the plural sub-stator blades 14 are located between the main stator blades 12 in a circumferential direction so as to have an interval therebetween. Accordingly, the number of the main stator blades 12 is the same as that of the sub-stator blades 14.

The main stator blade 12 is formed by a basic blade portion 12*a* which has the same shape as that of the sub-stator blade 14 and a forward blade portion 12*b* which extends to the upstream side of the basic blade portion. Accordingly, the basic blade portion 12*a* of the main stator blade has the same configuration as that of the sub stator blade 14 except for the existence of the forward blade portion 12*b*.

The basic blade portion 12*a* of the main stator blade 12 and the sub-stator blade 14 are located at the same position in an axial direction, and a basic stator blade row is formed therebetween. In this basic stator blade row, it is desirable to have a uniform circumferential interval between the basic blade portion 12*a* and the sub-stator blade 14, but the interval may be adjusted in accordance with a flow state.

The forward blade portion 12*b* of the main stator blade 12 forms a forward stator blade row which has a circumferential interval larger than that of the basic stator blade row 12*a* in the vicinity of at least a radial inner end (on a hub side). The circumferential interval of the forward stator blade row is approximately two times that of the basic stator blade row.

FIG. 4B is a schematic side view showing the stator blade row 10 according to the second embodiment of the invention.

In this example, a front edge 12*c* of the main stator blade 12 is located on the upstream side of a front edge 14*c* of the stator blade 14 from a radial middle portion to an outer end.

The other configurations are the same as those of the first embodiment.

According to the above-described configuration, as shown in FIG. 4C, it is possible to allow the circumferential interval of the forward stator blade row which is formed by the forward blade portions 12*b* to be larger than that of the basic stator blade row, which is formed by the basic blade portions 12*a* of the main stator blades 12 and the sub-stator blades 14, in the vicinity of at least the radial inner end (on the hub side) (by approximately two times). Accordingly, even in the case where a high-mach-number fluid 1 flows into the stator blade row on the hub side, it is possible to expect a wide dynamic range, high efficiency, and an expansion of a throat area 2 on the hub side determined by the interval of the forward blade row 12*b*.

As shown in FIG. 4D, since the basic blade portion 12*a* of the main stator blade has the same shape as that of the sub-stator blade 14 from the vicinity of a mid-span except for the vicinity of the radial inner end to the tip side, the basic stator blade row formed by the basic blade portion 12*a* of the main stator blade 12 and the sub-stator blade 14 has the same configuration as that of the conventional stator blade row, and the number of rotor blades and stator blades is the same as that of the conventional art, thereby maintaining a cutoff condition which is advantageous in noise caused by the interference between the rotor blade and the stator blade.

In addition, it is possible to realize a decrease in weight as a whole as much as the short sub-stator blade 14 on the hub side.

Figure 5:
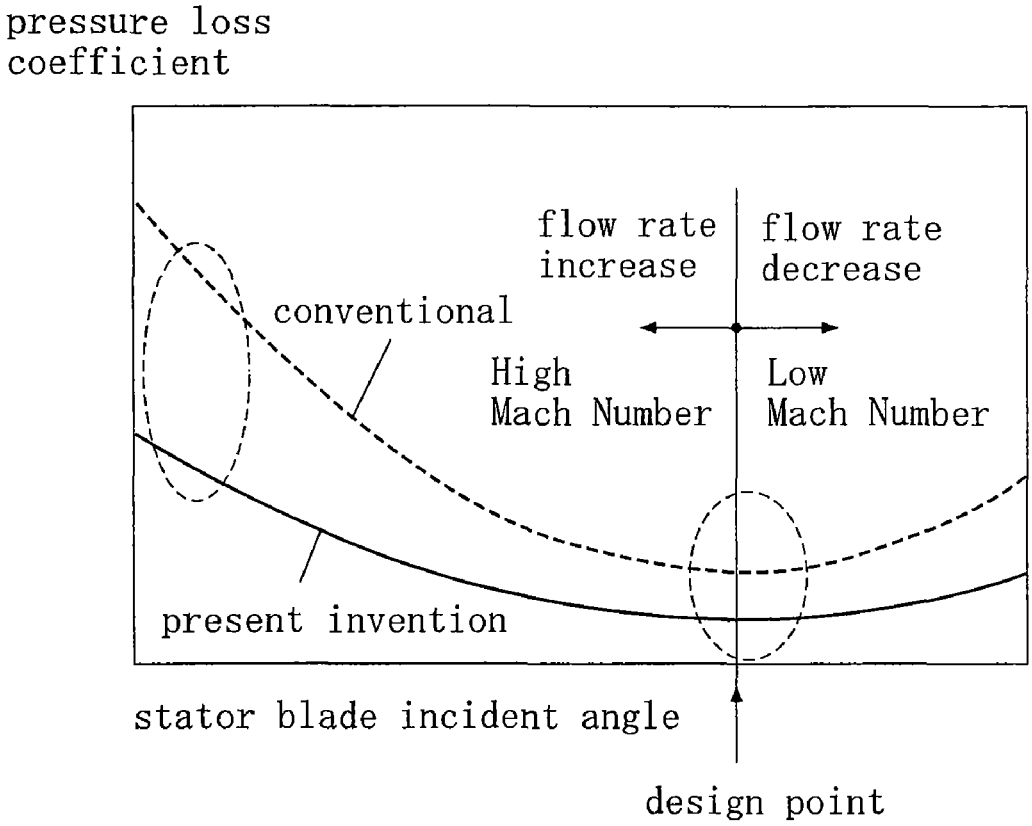
FIG. 5 is a diagrammatic view showing predicted performances according to the first and second embodiments.

FIG. 5 is a diagrammatic view showing predicted performances according to the first and second embodiments. In this drawing, a lateral axis indicates a stator blade incident angle, and a longitudinal axis indicates a pressure loss coefficient. In the drawing, a broken line indicates a conventional stator blade row, and a solid line indicates a stator blade row according to the invention.

As shown in this drawing, since the stator blade incident angle deviates from an optimal point when the flow rate increases or decreases with respect to a design point, the pressure loss coefficient largely increases. However, in the stator blade row according to the invention, since the number of blades of the forward stator blade row is smaller than that of (is a half of) the basic rotor blade row, even in the case where the fluid friction loss of the blade portion decreases and the stator blade incident angle varies, it is possible to reduce the pressure loss coefficient in a broad range and to efficiently increase the pressure.

Figure 6:
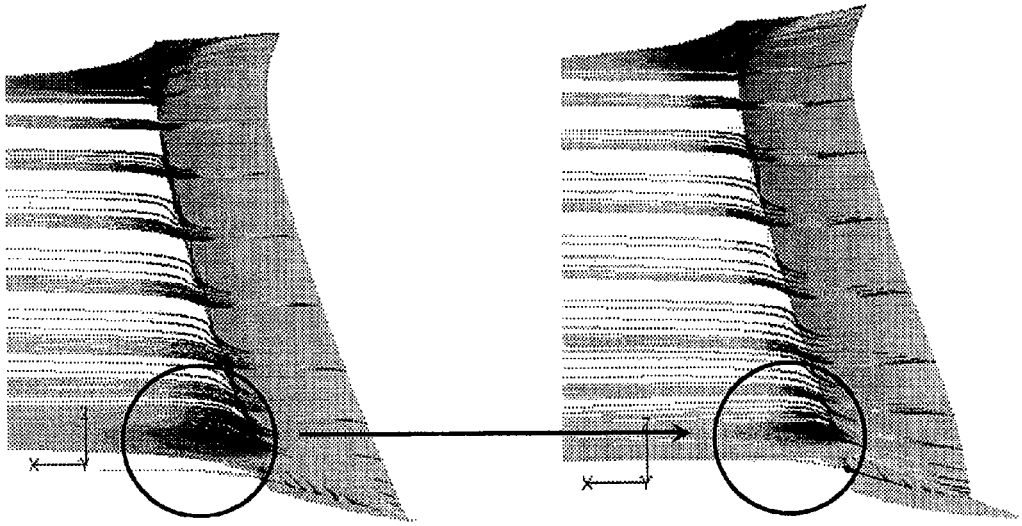
FIG. 6 is a view showing CFD analysis results according to the first and second embodiments.

FIG. 6 is a comparative view showing streamlines of the blade surfaces according to the conventional art and the invention. In this drawing, "a base type" on the left side shows the streamline according to the conventional art, and "an invented type" on the right side shows the streamline according to the invention.

This drawing shows the streamline in the vicinity of a negative pressure surface in the state where a fluid flows from the right side to the left side of the blade. At a position on the downstream side (the right side of the drawing) surrounded by a circle, when a dark colored area (low-mach-number area) becomes large, a low-energy area, in which the speed is low, becomes large and a loss area becomes large. From this drawing, it is understood that the loss area becomes small in the right drawing.

Figure 7A:
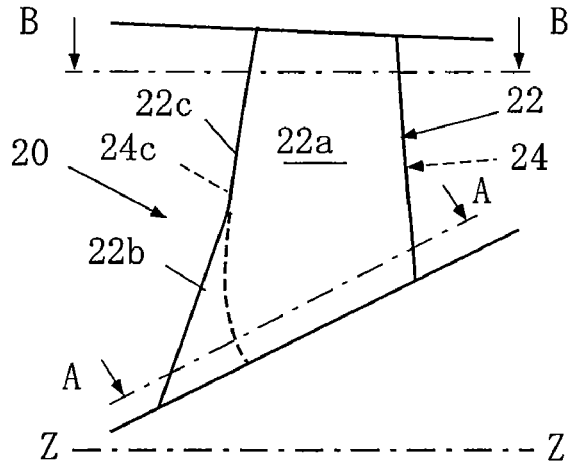
FIG. 7A is a view showing the blade row of the axial flow type compressor according to a third embodiment of the invention.
Figure 7B:
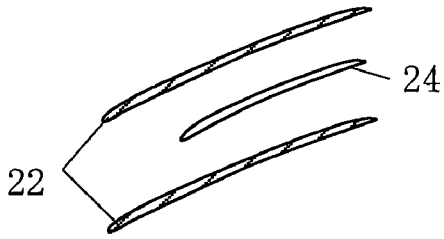
FIG. 7B is a sectional view taken along the line A-A of FIG. 7A.
Figure 7C:
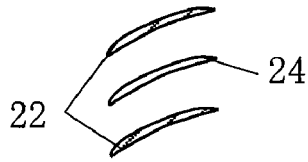
FIG. 7C is a sectional view taken along the line B-B of FIG. 7A.

FIGS. 7A to 7C show the third embodiment in which the blade row according to the invention is applied to a rotor blade row. In this drawing, FIG. 7A is a schematic side view showing a rotor blade row 20, FIG. 7B is a sectional view taken along the line A-A, and FIG. 7C is a sectional view taken along the line B-B.

In FIG. 7A, the rotor blade row 20 according to the invention is formed by plural main rotor blades 22 and plural sub-rotor blades 24. In this drawing, each sub-rotor blade 24 is located on the rear side of each main rotor blade 22.

The plural main rotor blades 22 are located in a circumferential direction of the rotary axis Z-Z of the rotor blade row so as to have an interval therebetween. Additionally, the plural sub-rotor blades 24 are located between the main rotor blades 22 so as to have an interval therebetween in a circumferential direction. Accordingly, the number of the main rotor blades 22 is the same as that of the sub-rotor blades 24.

The main rotor blade 22 is formed by a basic blade portion 22*a* which has the same shape as that of the sub-rotor blade 24 and a forward blade portion 22*b* which extends to the upstream side of the basic blade portion. Accordingly, the basic blade portion 22*a* of the main rotor blade has the same configuration as that of the sub rotor blade 24 except for the existence of the forward blade portion 22*b*.

The basic blade portion 22*a* of the main rotor blade 22 and the sub-rotor blade 24 are located at the same position in an axial direction, and a basic rotor blade row is formed therebetween. In this basic rotor blade row, it is desirable to have a uniform circumferential interval between the basic blade portion 22*a* and the sub-rotor blade 24.

The forward blade portion 22*b* of the main rotor blade 22 forms a forward rotor blade row which is formed in the vicinity of at least a radial inner end (on a hub side) so as to have a circumferential interval larger than that of the basic rotor blade row 22*a*. The circumferential interval of the forward rotor blade row is approximately two times that of the basic rotor blade row.

Figure 8A:
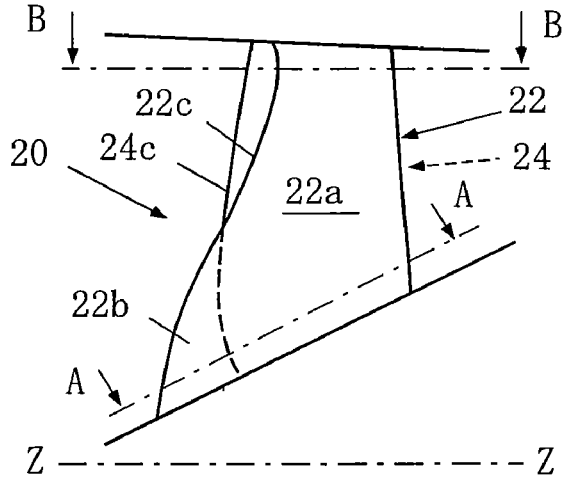
FIG. 8A is a view showing the blade row of the axial flow type compressor according to a fourth embodiment of the invention.
Figure 8B:
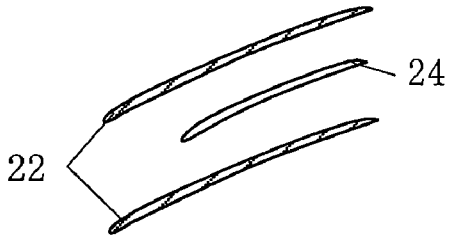
FIG. 8B is a sectional view taken along the line A-A of FIG. 8A.
Figure 8C:
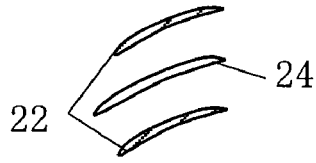
FIG. 8C is a sectional view taken along the line B-B of FIG. 8A.

FIGS. 8A to 8C are views showing the fourth embodiment in which the blade row according to the invention is applied to the rotor blade row. In this drawing, FIG. 8A is a schematic side view showing the rotor blade row 20, FIG. 8B is a sectional view taken along the line A-A, and FIG. 8C is a sectional view taken along the line B-B.

In this example, a front edge 22*c* of the main rotor blade 22 is located on the downstream side of a front edge 24*c* of the sub-rotor blade 24 from a radial middle portion to an outer end.

The other configurations are the same as those of the third embodiment.

According to the above-described configuration, the rotor blade row 20 is formed by the basic rotor blade row which is formed by the basic blade portion 22*a* of the main rotor blade 22 and the sub-rotor blade 24 and the forward rotor blade row which is formed by only the forward blade portion 22*b* of the main rotor blade 22. The number of blades of the forward rotor blade row is smaller than that of (is a half of) the basic rotor blade row. Accordingly, it is possible to reduce the fluid friction loss of the blade portion and to efficiently increase the pressure.

Since the circumferential interval of the forward rotor blade row in the vicinity of the radial inner end is larger than that of the basic rotor blade row (by approximately two times), it is possible to expect a wide dynamic range, high efficiency, and an expansion of a throat area on the hub side determined by the interval of the forward blade row.

With the configuration in which the front edge 22*c* of the main rotor blade 22 is located on the downstream side of the front edge 24*c* of the sub-rotor blade 24 from the radial middle portion to the outer end (the fourth embodiment), the circumferential interval of the front edge of the sub-rotor blade 24 on the tip side is large (by approximately two times). Accordingly, it is possible to expand the throat area at the tip side and to expect the pressure loss reduction at a high-ratio flow rate.

In addition, it is possible to realize a decrease in weight as a whole as much as the short sub-rotor blade on the hub side.

Therefore, according to the invention, in any case of the stator blade row 10 and the rotor blade row 20, it is possible to reduce pressure loss of the compressor, and to more increase an air flow rate while maintaining a compression characteristic than that of the conventional art.

Furthermore, the invention is not limited to the above-described embodiments, but may be, of course, modified into various forms without departing from the spirit of the invention.

The invention claimed is:

1. A blade row of an axial flow type compressor in which a rotor blade row and a stator blade row are alternately arranged in an axial direction, wherein the stator blade row is formed by plural main stator blades which are located in a circumferential direction of a rotary axis of the rotor blade row so as to have an interval therebetween and plural sub-stator blades which are located between the main stator blades in a circumferential direction so as to have an interval therebetween, wherein each main stator blade is formed by a basic blade portion which has the same shape as that of each sub-stator blade and a forward blade portion which extends to the upstream side of the basic blade portion, wherein the basic blade portion of the main stator blade and the sub-stator blade are located at the same position in an axial direction so as to form a basic stator blade row therebetween, and wherein the forward blade portion of the main stator blade forms a forward stator blade row which has a circumferential interval larger than that of the basic stator blade row in the vicinity of at least a radial inner end.

2. A blade row of an axial flow type compressor in which a rotor blade row and a stator blade row are alternately arranged in an axial direction, wherein the rotor blade row is formed by plural main rotor blades which are located in a circumferential direction of a rotary axis thereof so as to have an interval therebetween and plural sub-rotor blades which are located between the main rotor blades in a circumferential direction so as to have an interval therebetween, wherein each main rotor blade is formed by a basic blade portion which has the same shape as that of each sub-rotor blade and a forward blade portion which extends to the upstream side of the basic blade portion, wherein the basic blade portion of the main rotor blade and the sub-rotor blade are located at the same position in an axial direction so as to form a basic rotor blade row therebetween, and wherein the forward blade portion of the main rotor blade forms a forward rotor blade row which has a circumferential interval larger than that of the basic rotor blade row in the vicinity of at least a radial inner end.

3. The blade row of the axial flow type compressor according to claim 2, wherein a front edge of the main rotor blade is located on the downstream side of a front edge of the sub-rotor blade from a radial middle portion to an outer end.

* * * * *